US005504059A

United States Patent [19]

Higaki et al.

[11] Patent Number: 5,504,059

[45] **Date of Patent: *Apr. 2, 1996**

[54] SUPERCONDUCTING MICROWAVE PARTS HAVING A PACKAGE, THREE SUBSTRATES, AND LINE AND GROUNDING CONDUCTORS

[75] Inventors: Kenjiro Higaki; Hideo Itozaki, both of Itami, Japan

[73] Assignee: Sumitomo Electric Industries, Ltd., Osaka, Japan

[ * ] Notice: The term of this patent shall not extend beyond the expiration date of Pat. No. 5,496,797.

[21] Appl. No.: 344,689

[22] Filed: Nov. 18, 1994

Related U.S. Application Data

[63] Continuation of Ser. No. 141,587, Oct. 27, 1993, abandoned, which is a continuation of Ser. No. 781,351, Oct. 25, 1991, abandoned.

[30] Foreign Application Priority Data

| | | | |
|---|---|---|---|
| Oct. 29, 1990 | [JP] | Japan | 2-291196 |
| Nov. 13, 1990 | [JP] | Japan | 2-306732 |
| Oct. 23, 1991 | [JP] | Japan | 3-304101 |

[51] Int. Cl.[6] ..... H01P 3/08; H01B 12/06

[52] U.S. Cl. ..... 505/210; 505/700; 505/701; 505/866; 333/99 S; 333/246

[58] Field of Search ..... 333/995, 238, 333/246, 219; 505/1, 700, 701, 866, 210; 174/52.1; 361/752

[56] References Cited

U.S. PATENT DOCUMENTS

| | | | |
|---|---|---|---|
| 2,800,634 | 7/1957 | Grieg et al. | 333/238 |
| 5,075,655 | 12/1991 | Pond et al. | 333/99 S X |

FOREIGN PATENT DOCUMENTS

| | | | |
|---|---|---|---|
| 64101 | 3/1991 | Japan | 333/238 |

OTHER PUBLICATIONS

McAvoy, B. R., et al; "Superconducting Stripline Resonator Performance"; *Proc. 1988 Applied Superconductivity Conf;* 22 Aug. 1988.

*Primary Examiner*—Benny T. Lee
*Attorney, Agent, or Firm*—Beveridge, DeGrandi, Weilacher & Young

[57] ABSTRACT

There is disclosed a superconducting microwave component including a first substrate of a dielectric material with a conductor line of an oxide superconductor formed in a required pattern on the surface, a second substrate of a dielectric with a grounding conductor of an oxide superconductor formed on the surface, and a third substrate of a dielectric which is laid on the first and the second substrates, with the third substrate sandwiched between the first and the second substrates.

22 Claims, 3 Drawing Sheets

SUPERCONDUCTING MICROWAVE PARTS HAVING A PACKAGE, THREE SUBSTRATES, AND LINE AND GROUNDING CONDUCTORS

This application is a continuation of application Ser. No. 08/141,587, filed Oct. 27, 1993, abandoned, which application is entirely incorporated herein by reference, and which is a continuation of application Ser. No. 07/781,351, filed Oct. 25, 1991, respectively, now abandoned.

BACKGROUND OF THE INVENTION

1. Field of the Invention

This invention relates to superconducting microwave components. More specifically, this invention relates to high frequency parts for treating electromagnetic waves having short wavelengths, such as microwaves, millimeter waves or others, and especially to new constitutions of microwave components having the conductor layers formed of oxide superconducting materials.

2. Related Background Art

Although the electromagnetic waves having wavelengths from tens centimeters to some millimeters are called microwaves, millimeter waves or others are theoretically only a part of the electromagnetic wave spectrum, these electromagnetic waves are, in many cases, specially studied independently in the engineering field because special means and parts have been developed for treating these electromagnetic waves. The microwave line for guiding the electromagnetic waves in this band comprises a pair of conductor lines arranged through a dielectric and having one of the conductor lines grounded.

On the other hand, in 1986 $(La,Ba)_2CuO_4$ which exhibits superconductivity at 30 K was discovered by Bednorz, Mueller, et al. In the next year 1987 $YBa_2Cu_3O_4$ having a critical superconducting temperature in the order of 90 K was discovered by Chu, et al. In 1988 Maeda, et al. discovered the so-called Bi-based composite oxide superconducting material which exhibits a critical superconducting temperature exceeding 100 K. Since these composite oxide superconductors can realize superconductivity by their being cooled by inexpensive liquid nitrogen, the possibility of practical applications of the superconducting technique has been suddenly noted.

Microwave components also enjoy the characteristic phenomena of superconductivity. That is, generally in a strip line the attenuation constant of a conductor due to a resistance is proportional to a square root of a frequency. The dielectric loss also increases with an increase of frequency. The dielectric loss in the recent strip lines is almost attributed mainly to a resistance of a conductor layer especially in the band equal to or lower than 10 GHz owing to the improvement of dielectric materials. Accordingly it improves the efficiency of the strip line to decrease the resistance of a conductor layer of the strip line. That is, by making a conductor line superconducting, the propagation loss is much reduced while the applicable frequency band is expanded toward the higher frequency side.

Microwave strip lines not only can be used as mere transmission lines, but also can be patterned suitably to be microwave components, such as inductors, filters, resonators, delay lines, directional couplers, etc. Accordingly the improvement of strip lines leads to the improvement of the characteristics of such microwave components.

Since the use of oxide superconducting materials as superconducting materials enables superconductivity to be realized by use of inexpensive liquid nitrogen, it is possible that microwave components of higher performance will prevail in more various fields.

But it is impossible to obtain microwave components which sufficiently take advantage of the characteristics of superconductors, by simply replacing the metal conductors of microwave components with oxide superconductors.

One reason for this is that further decrease of the dielectric loss is necessary. That is, in the conventional microwave lines using metal conductors the dielectric loss in comparison with the conductor loss of the metal conductor has been sufficiently decreased. In the case where superconductors are used as the conductor lines, the decrease of the dielectric loss is again brought up as a problem to be solved since the conductor loss can be minimized.

On the other hand, it is known that oxide superconductors can have good characteristics when the superconducting films are formed on specific substrates, as of MgO, $SrTiO_3$, etc. But all the oxides of MgO, $SrTiO_3$, etc. do not have good characteristics of dielectrics. But when oxide superconducting films are formed on substrates, as of sapphire, $SiO_2$, etc., having very low dielectric losses, the superconductive characteristics of the superconducting films are deteriorated or lost. Thus it is substantially impossible to form oxide superconducting films which are to be conductor lines, directly on these dielectric substrates of low dielectric losses. In short, it is impossible to fabricate microwave components which exhibit effective characteristics simply by replacing the conductor portions of the conventional microwave components formed of metal conductors with oxide superconductors.

SUMMARY OF THE INVENTION

It is one object of this invention to provide microwave components which can solve the above-described problem, and which have innovational constitutions which can make sufficient use of the characteristics of the oxide superconductors.

It is another object of the present invention to provide a superconducting microwave component comprising a first substrate of a dielectric material with a conductor line of an oxide superconductor formed in a required pattern on the surface, a second substrate of a dielectric with a grounding conductor of an oxide superconductor formed on the surface, and a third substrate of a dielectric which is laid on the first and the second substrates with the third substrate sandwiched between the first and the second substrates.

It is further object of the present invention to provide a superconducting microwave component comprising a first substrate of a dielectric material with a conductor line of an oxide superconductor formed in a required pattern on the surface, a second substrate of a dielectric with a grounding conductor of an oxide superconductor formed on the surface, and a holding member for holding the first and the second substrates substantially parallel with each other with a required gap therebetween.

It is a further object of the present invention to provide a superconducting microwave component comprising a first substrate of a dielectric material with a conductor line of an oxide superconductor formed in a required pattern on the surface, a second substrate of a dielectric with a grounding conductor of an oxide superconductor formed on the surface, and a third substrate of a dielectric, the first, the second, and the third substrates being laid on each other so that the third substrate is sandwiched between the first and the second substrates with parts of the third substrate being exposed on the side of the first substrate, and conductor layer patterns statically connected to the conductor line being formed on the exposed parts of the third substrate.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENT

Embodiment 1

Figure 1:
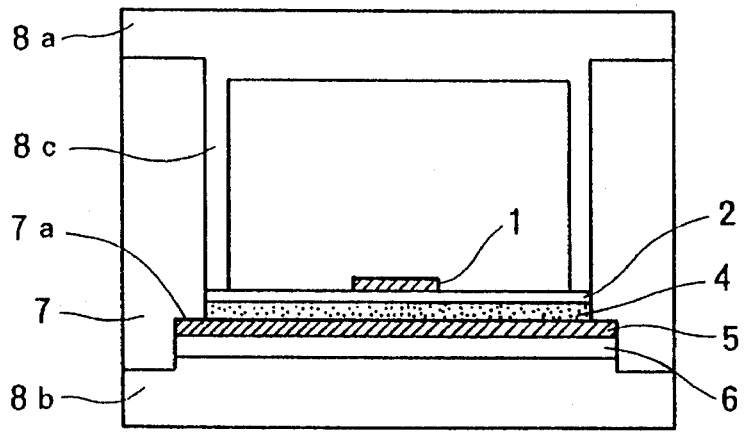
FIG. 1 is a sectional view of the structure of a microwave component according to one embodiment of this invention.

FIG. 1 is a sectional view schematically showing the structure of the microwave component according to one embodiment of this invention.

The microwave component of FIG. 1 comprises a first substrate 2 having a conductor line 1 formed of an oxide superconducting film depicting a required pattern, a dielectric strip 4, and a second substrate 6 having a superconducting grounding conductor 5 formed of a superconducting film, which are laid on each other in a package 7, and the package is sealed with covers 8*a*, 8*b*. Although not shown, a lead for connecting the superconductor line 1 to the outside of the package 7 is actually provided through the package 7, or through the covers 8*a*, 8*b*.

In this microwave component, the first substrate 2 and the second substrate 6 have different sizes. A step 7*a* is formed on the inside of the package 7 for accommodating the size difference. That is, the second substrate 6 has a larger size than the first substrate 2, and the grounding superconductor 5 on the second substrate 6 is in contact at the boundary portion with the step 7*a* on the inside of the package 7. A rib 8*c* is formed on the underside of the cover 8*a* for pressing down the first substrate 2.

In the microwave component of the above-described structure, the conductor line 1 and the superconducting grounding conductor 5 are formed respectively of Y-based, Bi-based, Tl-based or others-based oxide superconducting films. The substrates 2 and 6 are formed of oxides, such as MgO, $SrTiO_3$ or others, which permit those oxide films to be well formed. The dielectric strip 4 is formed of a material, e.g., Sapphire, whose dielectric loss is very small.

Fabrication Example 1

A microwave resonator, which is one of the microwave components, having the sectional structure of FIG. 1 was fabricated.

As the first substrate 2, a single MgO crystal substrate which is a 18 mm-square having a thickness 0.1 mm was used. As the second substrate 6, an MgO single crystal substrate which is 20 mm-square having a thickness of 1 mm was used.

The conductor line 1 and the superconducting grounding conductor 5 formed respectively on the substrate were formed of thin films of Y—Ba—Cu composite oxide. Table 1 shows the film preparation conditions.

TABLE 1

| | |
|---|---|
| Evaporation source | Y, Ba, Cu (metal) |
| Gas pressure | $2 \times 10^{-4}$ (Torr) |
| Substrate temperature | 600 (°C.) |
| Film thickness | 6000 (Å) |

When the oxide films were formed, $O_3$ gas was blown onto the film forming surfaces of the substrates from a ring nozzle positioned near the film forming surfaces. The blown $O_3$ gas was vaporized liquid ozone cooled by nitrogen gas and was substantially pure $O_3$ gas. The feed amount of the $O_3$ gas was 20 cc/min.

The oxide superconducting films formed on the first substrate 2 were patterned into the conductor line 1. The patterning was performed by wet-etching using hydrochloric acid as the etchant. A straight conductor line having 1.1 mm-width and 8.0 mm-length was formed, and a pair of pads for leading microwaves was formed in the conductor line.

The dielectric strip 4 was prepared by machining Sapphire plate. This dielectric strip 4 had the same size as the first substrate 2 and had 0.9 mm-thickness.

The package 7, and the covers 8*a*, 8*b* were made of brass. By making the package 7 and the covers 8*a*, 8*b* of a metal, the cooling was facilitated and efficient.

The prepared members were fabricated into a microwave resonator of the structure shown in FIG. 1.

For comparison, a microwave resonator was prepared. That is, a conductor line was formed of the same oxide superconducting film in the same size and the material except that the thickness of the first substrate 2 was 1.0 mm. This conductor line was housed in the same package. But this sample as a control did not include the dielectric strip 4, and the first substrate 2 was laid directly on the superconducting grounding conductor 5.

The thus-fabricated example sample and control sample were measured by a network analyzer with respect to the frequency dependency of power, and Q-values of the respective samples as resonators. The measured results are shown in Table 2. It is shown that Q-value of the resonance can be made larger by thinning the first substrate 2 and disposing the dielectric strip 4 between the first and the second substrates 2 and 4.

TABLE 2

| | Frequency (GHz) | |
|---|---|---|
| | 6.9 | 13.7 |
| Q-value | | |
| Example | 1610 | 1270 |
| Control | 1390 | 1012 |

Embodiment 2

Figure 2A:
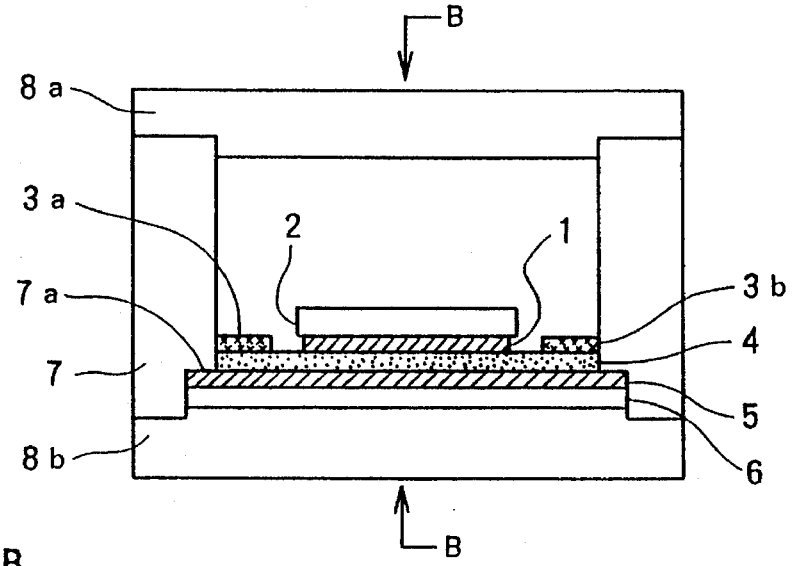
FIGS. 2A, 2B are sectional views of a microwave component according to other embodiments of this invention.
Figure 2B:
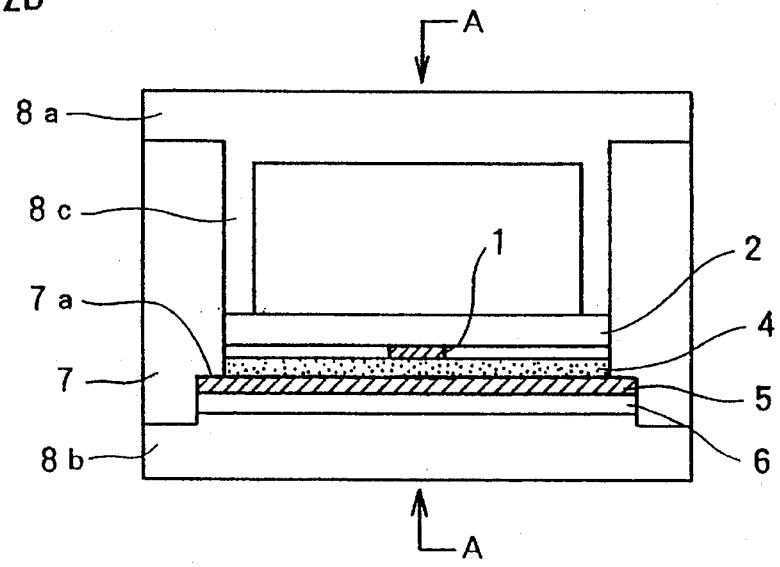
Figure 3:
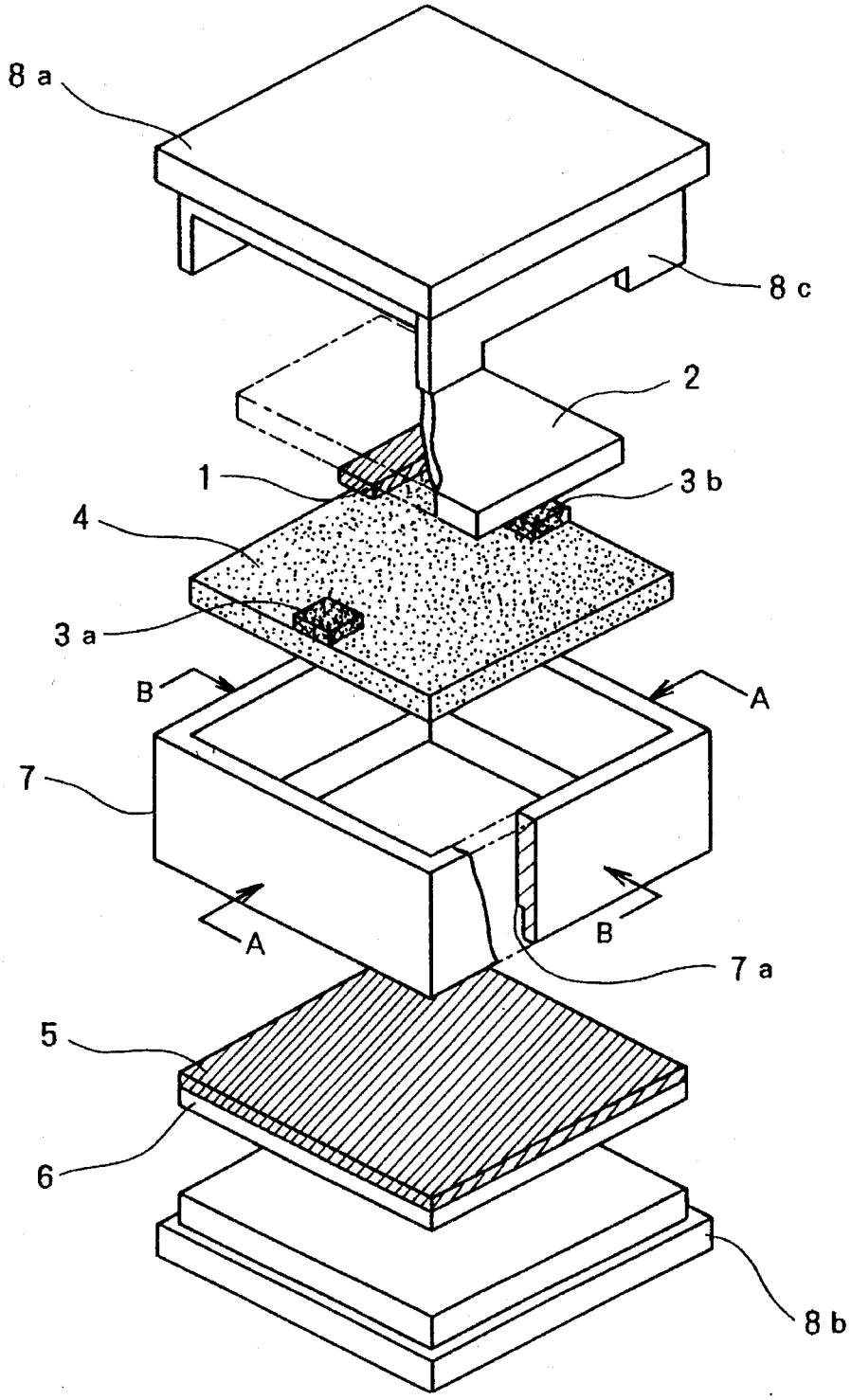
FIG. 3 is a view showing the configurations of the members of the microwave component of FIG. 2A.

FIGS. 2A and 2B are sectional views schematically showing the structure of a microwave component according to another embodiment of this invention. FIG. 3 is a view showing the members of the microwave component of FIG. 2A. The members of the second embodiment which are common with the first embodiment have the same reference numerals.

As shown in FIGS. 2A and 3, the microwave component according to a second embodiment comprises a first substrate 2 having a conductor line 1 formed on the underside, a dielectric strip 4 having a pair of waveguides 3*a*, 3*b*, and a second substrate 6 having a superconducting grounding conductor 5 formed on its surface, which elements are layered on each other and housed in a package 7. The package 7 is sealed with covers 8*a*, 8*b*. Although not shown, a lead is actually provided through the package 7, or through the covers 8*a*, 8*b* for connecting the conductor line 1 to the outside of the package 7.

In this microwave component, the first substrate 2, the dielectric strip 4, and the second substrate 6 have different sizes from one another. To accommodate a size difference there is formed a step 7*a* on the inside of the package 7. That is, the size of the second substrate 6 is larger than that of the first substrate 1 and that of the dielectric strip 4. The superconducting grounding conductor 5 is in contact at the boundary portion with the step 7*a* on the inside of the package 7. On the underside of the cover 8*a* there may be provided a rib 8*c* (FIGS. 2B, 3) for pressing down the first substrate 2. Since the first substrate 2 and the dielectric strip 4 have different sizes, in the laid state the first substrate 2 is superposed on a part of the dielectric strip 4 with parts of the surface of the dielectric strip 4 exposed. In these exposed parts a pair of waveguides 3*a*, 3*b* (FIGS. 2A, 3) are formed. These waveguides 3*a*, 3*b* of a metal film are coupled with the conductor line 1 of an oxide superconductor by an electrical coupling.

In this microwave component, the conductor line 1, and the grounding conductor 5 are formed of Y-based, Bi-based, Tl-based or others-based oxide superconducting films. The substrates 2 and 8 are provided by insulating substrates of MgO, $SrTiO_3$ or others on which the above-mentioned oxide superconducting films can be well formed. The dielectric strip 4 is formed of a material, such as Sapphire or others, having small dielectric loss. For the metal film of the waveguides 3*a*, 3*b* a stable material, such as Au or others, is used.

Fabrication Example 2

Microwave resonators of FIGS. 2A, 2B and 3 were fabricated.

As the first substrate 2, MgO single crystal substrate having 0.2 mm-thickness, 18 mm-width and 10 mm-length was used. As the second substrate 6, MgO single crystal substrate 1 mm-thickness, 20 mm-width and 20 mm-length was used. As the dielectric strip 4 a 0.5 mm thickness, 18 mm-width and 18 mm-length Sapphire strip was used.

The conductor line 1 and the grounding conductor 5 were formed of Y—Ba—Cu composite oxide film on the respective substrates. The film preparation conditions are shown in Table 3.

TABLE 3

| | |
|---|---|
| Evaporation source | Y, Ba, Cu (metal) |
| Gas pressure | $2 \times 10^{-4}$ (Torr) |
| Substrate temperature | 600 (°C.) |
| Film thickness | 6000 (Å) |

When the oxide films were formed, $O_3$ gas was blown onto the film forming surfaces of the substrates from a ring nozzle positioned near the film forming surfaces The blown $O_3$ gas was vaporized liquid ozone cooled by nitrogen gas and was substantially pure $O_3$ gas. The feed amount of the $O_3$ gas was 20 cc/min. The oxide superconducting films on the first substrate 2 were patterned into the conductor line 1. The patterning was performed by wet-etching using hydrochloric acid as the etchant. A straight conductor line having 0.56 mm-width and 8 mm-length was formed.

The waveguides 3*a*,3*b* were formed of Au by evaporation. The patterning was conducted by a lift-off technique.

The package 7, and the covers 8*a*, 8*b* were made of brass.

The members were fabricated into the microwave resonator of FIG. 2.

As a control, a microwave resonator was prepared. That is, a conductor layer and a waveguide were formed of Au on one dielectric substrate, and a grounding conductor layer of Au was formed on the entire underside of the substrate. The microwave resonator was housed in a package of substantially the same package structure.

The example sample and control sample were measured by a network analyzer with respect to power and frequency dependency, and Q-values of the respective samples as resonators. The measured results are shown in Table 4. The measuring temperature was 77 K.

TABLE 4

| | Frequency (GHz) | |
|---|---|---|
| | 7.1 | 13.9 |
| Q-value | | |
| Embodiment | 1780 | 1420 |
| Control | 550 | 720 |

Figure 4A:
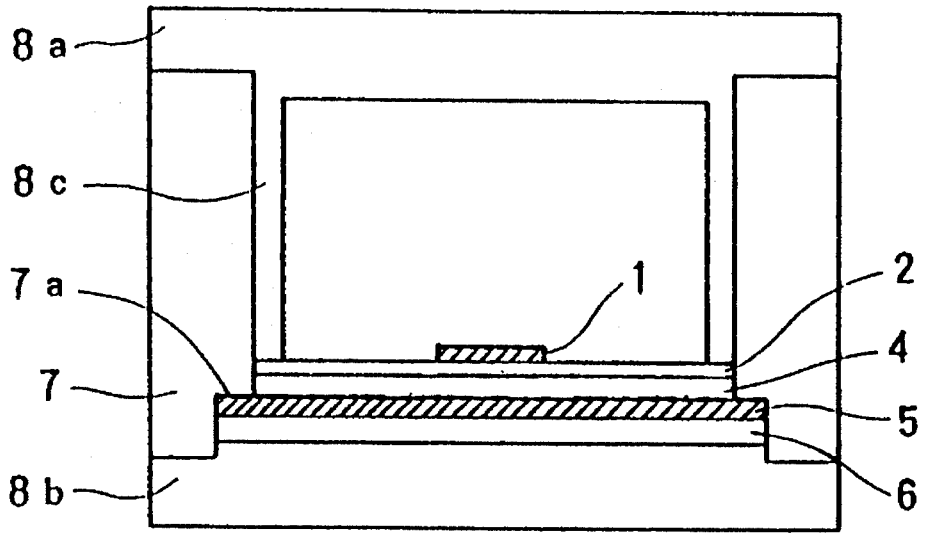
FIGS. 4A and 4B are sectional views of microwave components according to still other embodiments of the present invention.
Figure 4B:
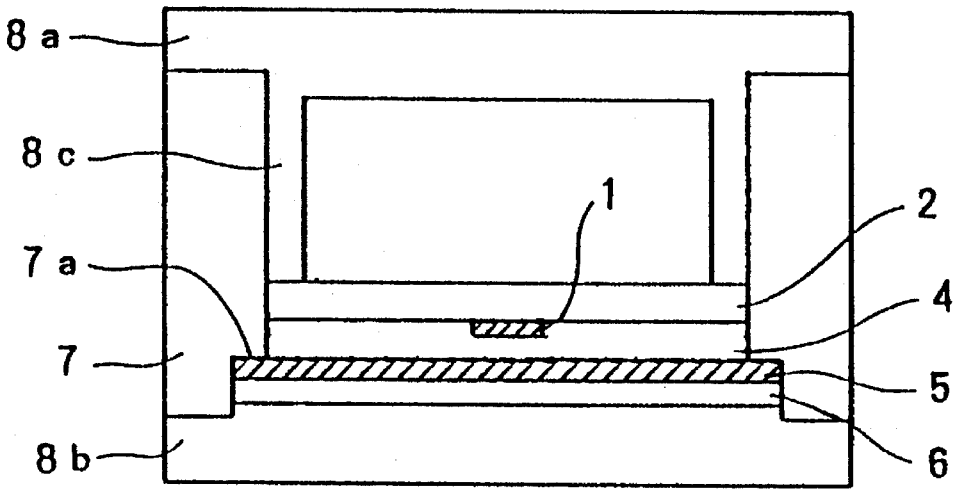

The microwave components according to this invention are characterized mainly in that a conductor line and a grounding conductor both of oxide superconducting films are formed on respective optimal substrates, and then the substrates are laid together with the dielectric strip. Alternatively, a gap 4' in which is provided a vacuum layer or an air layer can be substituted for the dielectric strip as shown in FIGS. 4A and 4B, whereby a microwave line is formed.

As described above, an oxide superconducting film cannot be formed directly on a dielectric strip having a dielectric loss corresponding to a lower conductor loss of a superconductor. Then in the microwave components according to this invention, an oxide superconducting film, which is the conductor layer, is formed on a specific substrate which can provide good superconducting properties, and this conductor layer is superposed on the dielectric strip formed of a material having a small dielectric loss or the substrate is opposed to the dielectric strip with a certain gas therebetween, whereby a microwave line having good characteristics is realized. It is not essential that the waveguide for guiding a microwave from the outside is superconducting. The waveguide may be formed of a metal film formed on the dielectric strip.

When the thickness of the substrates for the oxide superconducting films is increased because an oxide substrate material of the substrates, such as YSZ, $SrTiO_3$, MgO, $LaAlO_3$, $NdGaO_3$, $Y_2O_3$ or others, does not have especially superior properties, the influence of the substrates as dielectrics becomes unnegligible. Accordingly, it is preferable that these substrates are thinned as much as possible when the faces of the substrates opposite to the faces with the conductor line and the grounding conductor respectively formed thereon are positioned on the side of the dielectric strip or a gap as a substitute for the dielectric strip. By this arrangement it is not necessary to make the substrates especially thin.

In order to reduce as much as possible the influence of the material of the substrates for the oxide superconducting films, preferably a couple of the substrates with the conductor layer and the grounding conductor layer respectively formed thereon are so arranged that the oxide superconducting films are opposed to each other in order to hinder the direct contact of the respective oxide superconducting films with the dielectric strip.

As oxide superconducting materials of the conductor layer and the grounding conductor layer, oxide superconducting materials which have especially high superconducting critical temperatures and become superconductive by cooling with liquid nitrogen are exemplified by Y-based composite oxides, and composite oxides containing Tl and/or Bi. But in this invention the materials of the conductor layer and the grounding conductor layer are not limited to them. For example, Ln—Ba—Cu—O (Ln: Y, La, Nd, Sm, Eu, Gd, Dy, Ho, Er, Tm, Yb, Lu)-based, Bi—Sr—Ca—Cu—O-based, Bi—Pb—Sr—Ca—Cu—O-based, Tl—Ba—Ca—Cu—O-based, or Tl—Bi—Ca—Sr—Cu—O-based etc. are usable.

The dielectric material which is preferably used in the microwave components according to this invention are exemplified by Sapphire $LaAlO_3$, $NdGaO_3$, beryllia and borosilicate glass, etc. having a small dielectric tangent tanδ. Sapphire is especially preferable because its dielectric loss is lower by more than one place compared with $LaAlO_3$ and YSZ. In the microwave components according to this invention, the third substrate (the dielectric strip) is preferably formed of the above-mentioned dielectric materials, but may be formed of any dielectric material because no oxide superconducting film is formed thereon. Accordingly it is possible to substitute the dielectric strip with an air layer (FIGS. 4A, 4B) or a vacuum layer.

The conductor line formed on the first substrate, the grounding conductor on the second substrate, and the dielectric strip (the third substrate), which are formed respectively of the above-mentioned materials, are laid on each other and housed in a suitable package, and a microwave line can be readily fabricated.

The conductor line can be formed in an optional pattern by a lift-off technique in which a resist mask is prepared on the substrate before the formation of the superconducting film. The patterning of the conductor line can be performed also by wet-etching the conductor layer formed on the entire surface of the substrate with an etchant, such as hydrochloric acid or others. A suitable patterning is formed by these methods, and various microwave components can be fabricated as described above.

The microwave components according to this invention have very low transmission loss and have a wide usable frequency band. Furthermore, the microwave components exhibit good properties by cooling with liquid nitrogen.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

We claim:

1. A superconducting microwave component comprising:

a first substrate comprised of a first dielectric material and having a first surface and a conductor line comprised of an oxide superconductor disposed on the first surface thereof;

a second substrate comprised of the first dielectric material and having a second surface and a grounding conductor comprised of an oxide superconductor disposed on the second surface thereof;

a third substrate comprised of a second dielectric material different from the first dielectric material, the third substrate being sandwiched between the first and the second substrates, and the conductor line and the grounding conductor facing each other through the first substrate and the third substrate; and a package comprised of a conducting material, the package housing the first, second and third substrates such that the first and second surfaces are arranged substantially in parallel, at least one part of the grounding conductor electrically contacting an inner surface of the package by direct surface contact therewith, the package comprising a bottom plate, and a casing having a lower end portion with a lower end face fixed to a peripheral edge portion of the bottom plate and a first stepped face defining in part said inner surface, said first stepped face being proximate the lower end face, whereby a peripheral edge portion of the second substrate is held between the bottom plate and the first stepped face.

2. A superconducting microwave component according to claim 1, wherein the first substrate is so arranged that the conductor line thereon faces a side of the third substrate.

3. A superconducting microwave component according to claim 2, wherein the second substrate is so arranged that a surface thereof opposite to the second surface having the grounding conductor thereon faces the third substrate; and the second substrate has a thickness which is thinner than a thickness of the first substrate.

4. A superconducting microwave component according to claim 1, wherein the first and the second substrates are so arranged that surfaces thereof opposite to the first surface having the conductor line thereon and the second surface having the grounding conductor thereon respectively face the third substrate; and the first and the second substrates have thicknesses which are thinner than a thickness of the third substrate.

5. A superconducting microwave component according to claim 1, wherein the second substrate is so arranged that the grounding conductor thereon faces the third substrate.

6. A superconducting microwave component according to claim 5, wherein the first substrate is so arranged that a surface thereof opposite to the first surface having the conductor line thereon faces the third substrate; and the first substrate has a thickness which is thinner than a thickness of the second substrate.

7. A superconducting microwave component according to claim 1, wherein the oxide superconductor is selected from the group consisting of: Ln element—Ba—Cu—O based material, Bi—Sr—Ca—Cu—O based material, Bi—Pb—Sr—Ca—Cu—O based, Tl—Ba—Ca—Cu—O based material, and Tl—Bi—Ca—Sr—Cu—O based material.

8. A superconducting microwave component according to claim 1, wherein the first substrate and the second substrate respectively are comprised of materials selected from the group consisting of: MgO, $SrTiO_3$, $LaAlO_3$, $NdGaO_3$, and $Y_2O_3$.

9. A superconducting microwave component according to claim 1, wherein the third substrate is comprised of a material selected from the group consisting of: $Al_2O_3$, $SiO_2$, beryllia, and borosilicate glass.

10. A superconducting microwave component according to claim 1, wherein the package further comprises a holding member for holding the first, the second, and the third substrates in a laminar structure.

11. A superconducting microwave component according to claim 10, wherein the holding member is comprised of a metal.

12. A superconducting microwave component comprising:

a first substrate comprised of a first dielectric material and having a first surface and a conductor line comprised of an oxide superconductor disposed on the first surface thereof; and a second substrate comprised of the first dielectric material and having a second surface and a grounding conductor comprised of an oxide superconductor disposed on the second surface thereof;

the first and the second substrates being separated by a gap which has a predetermined thickness; and a package comprised of a conducting material, the package housing the first and second substrates such that the first and second surfaces are arranged substantially in parallel, at least one part of the grounding conductor electrically contacting an inner surface of the package by direct surface contact therewith, the package comprising a bottom plate, and a casing having a lower end portion with a lower end face fixed to a peripheral edge portion of the bottom plate and a first stepped face defining in part said inner surface, said first stepped face being proximate the lower end face, whereby a peripheral edge portion of the second substrate is held between the bottom plate and the first stepped face.

13. A superconducting microwave component according to claim 12, wherein gas is present in the gap between the first and the second substrates.

14. A superconducting microwave component according to claim 12, wherein the first surface having the conductor line disposed thereon and the second surface having the grounding conductor disposed thereon are opposed to each other.

15. A superconducting microwave component according to claim 12, wherein the oxide superconductor is selected from the group consisting of: Ln element—Ba—Cu—O based material, Bi—Sr—Ca—Cu—O based material, Bi—Pb—Sr—Ca—Cu—O based material, Tl—Ba—Ca—Cu—O based material and Tl—Bi—Ca—Sr—Cu—O based material.

16. A superconducting microwave component according to claim 12, wherein the first substrate and the second substrate are respectively comprised of materials selected from the group consisting of: MgO, SrTiO, LaAlO, $NdGaO_3$, and $Y_2O_3$.

17. A superconducting microwave component comprising:

a first substrate comprised of a first dielectric material and having a first surface;

a conductor line comprised of an oxide superconductor disposed on the first surface of the first substrate;

a second substrate comprised of the first dielectric material and having a second surface; and a grounding conductor comprised of an oxide superconductor disposed on the second surface of the second substrate;

the first and second substrates being arranged such that the first and second surfaces thereof are substantially in parallel, the first and second substrates being separated by a gap which has a predetermined thickness, and the gap comprising a vacuum region between the first and the second substrates.

18. A superconducting microwave component comprising:

a first substrate comprised of a first dielectric material and having a first surface and a conductor line comprised of an oxide superconductor disposed on the first surface thereof;

a second substrate comprised of the first dielectric material and having a second surface and a grounding conductor comprised of an oxide superconductor disposed on the second surface thereof; and a third substrate comprised of a second dielectric material different from the first dielectric material, the first, the second, and the third substrates being stacked so that the third substrate is sandwiched between the first and the second substrates, the conductor line being sandwiched between the first substrate and the third substrate, conductor layer patterns that are electrostatically coupled with the conductor line and that are located on the third substrate; and a package comprised of a conducting material, the package housing the first and second substrates such that the first and second surfaces are arranged substantially in parallel, at least one part of the grounding conductor electrically contacting an inner surface of the package by direct surface contact therewith, the package comprising a bottom plate, and a casing having a lower end portion with a lower end face fixed to a peripheral edge portion of the bottom plate and a first stepped face defining in part said inner surface, said first stepped face being proximate the lower end face, whereby a peripheral edge portion of the second substrate is held between the bottom plate and the first stepped face.

19. A superconducting microwave component according to claim 18, wherein the conductor layer pattern is comprised of a metal.

20. A superconducting microwave component according to claim 18, wherein the oxide superconductor is selected from the group consisting of: Ln element—Ba—Cu—O based material, Bi—Sr—Ca—Cu—O based material, Bi—Pb—Sr—Ca—Cu—O based material, Tl—Ba—Ca—Cu—O based material, and Tl—Bi—Ca—Sr—Cu—O based material.

21. A superconducting microwave component according to claim 18, wherein the first and the second substrates are respectively comprised of materials selected from the group consisting of: MgO, $SrTiO_3$, $LaAlO_3$, $NdGaO_3$, or and $Y_2O_3$.

22. A superconducting microwave component according to claim 18, wherein the third substrate is comprised of a material selected from the group consisting of: $Al_2O_3$, $SiO_2$, beryllia, and borosilicate glass.

* * * * *